United States Patent [19]

Higgins

[11] Patent Number: 5,031,870

[45] Date of Patent: Jul. 16, 1991

[54] DISPLAY CARD MOUNTING DEVICE

[75] Inventor: Wayne C. Higgins, Milwaukee, Wis.

[73] Assignee: Eddy Associates, Inc., New Berlin, Wis.

[21] Appl. No.: 455,629

[22] Filed: Dec. 22, 1989

[51] Int. Cl.[5] ..... G09F 1/10; G09F 7/02

[52] U.S. Cl. ..... 248/473; 40/124; 40/611

[58] Field of Search ..... 248/473; 40/124, 611

[56] References Cited

U.S. PATENT DOCUMENTS

| | | | |
|---|---|---|---|
| 715,532 | 12/1902 | Anderson | 248/473 |
| 2,268,077 | 12/1941 | Leonard | 248/473 |
| 4,473,963 | 10/1984 | Hardy et al. | 40/651 |

*Primary Examiner*—Reinaldo P. Machado

*Attorney, Agent, or Firm*—Michael, Best & Friedrich

[57] ABSTRACT

A display device for releasably supporting cards, signs, and the like, the display device including a frame having an aperture for receiving at least part of a display card, means housed in the frame for securing the display card within the frame, the means for securing including a card engaging member movable between a card retaining position wherein the card is secured in the frame and a card releasing position. The display device also includes manually operable means at least partially housed in the frame for selectively moving the card engaging member between the card retaining and the card releasing positions, and means for locking the card engaging member in the card retaining or card releasing position.

24 Claims, 2 Drawing Sheets

DISPLAY CARD MOUNTING DEVICE

BACKGROUND OF THE INVENTION

1. Field of the Invention

The invention relates generally to structures for supporting cards, signs, and the like, and, more particularly, to display devices for mounting display cards or signs, and the like.

2. Reference to Prior Art

Stores, restaurants, and other commercial establishments commonly use display signs, cards, or other such indicia to identify goods or services, to indicate the prices of goods or services, or to otherwise draw the attention of consumers. Typically, display cards or signs are made of paper, cardboard, or plastic, and come in a variety of shapes and sizes. Often, the display card or sign must be periodically changed to reflect changes in merchandise or services, prices, or other such information. Various types of card or sign mounting devices have been used in the past to support indicia on a stand of some sort. One such sign support is shown, for example, in Hardy et al. U.S. Pat. No. 4,473,963, which discloses an apparatus for releaseably attaching a sign to a display stand.

SUMMARY OF THE INVENTION

The invention provides a new and useful display device for supporting display cards, signs, and like. The display device is simple in its design and easy to operate. The display device includes a frame having an aperture for receiving at least part of a display card, and means housed in the frame for securing the display card within the frame, the means for securing including a card engaging member movable between a card retaining position wherein the card engaging member engages or grips the card, preventing removal of the card from the frame, and a card releasing position. The display device also includes manually operable means at least partially housed in the frame for selectively moving the card engaging member between the card retaining and the card releasing positions.

More specifically, the invention provides in one embodiment a display device including a frame having a slot for receiving at least part of a display card, and a flexible member housed in the frame, the flexible member including a first portion fixed to the frame and a second portion having a card engaging member, the card engaging member being movable between a card retaining position and a card releasing position. The display device also includes a manually operable slide at least partially housed in the frame, the slide being movable to selectively position the card engaging member in the card retaining position or in the card releasing position.

In one embodiment, the card engaging member comprises a projection and the card has a slot so that when the engaging member is in the card retaining position, the projection protrudes through the slot in the card, thereby preventing removal of the card from the frame.

In one embodiment, the frame is formed by a pair of elongated members which are attached to one another and which define an elongated cavity, and the flexible member is an elongated spring.

In one embodiment, the slide may include one or more pins, and the flexible member may include one or more detents so that when a pin engages a detent, the card engaging member is releaseably locked in a card retaining or a card releasing position.

A principal feature of the invention is the provision of a tamper-resistant display device for supporting display cards, signs, and the like.

Another feature of the invention is the provision of a display device which is manually operable without the use of tools to selectively secure display cards within the display device or to release display cards from the display device.

Another feature of the invention is the provision of a display device which includes means for locking the device in a card retaining position or a card releasing position, the means for locking indicating locked positions both audibly and tactily.

Another feature of the invention is the provision of a display card which is specially adapted to be locked into the display device.

Other features of the invention will become apparent to those skilled in the art upon review of the following detailed description, claims, and drawings.

Figure 1:
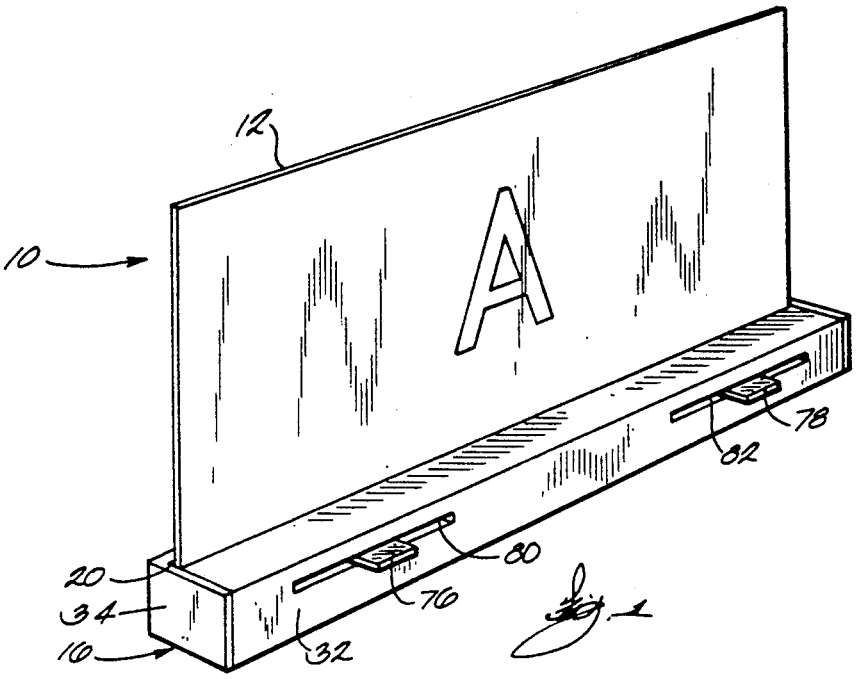
FIG. 1 is a perspective view of a card display device embodying various features of the invention shown supporting a display card.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A display device 10 for supporting cards, signs, and the like, and embodying various features of the invention is illustrated in the drawings. As shown in FIG. 1, the display device 10 is preferably used to support a display sign or card 12. While display cards can come in a variety of sizes and shapes, the display card 12 is shown as being rectangular. While the display device 10 illustrated in the drawings is shown as housing a rectangular card 12, display devices can be made to accommodate display cards of various configurations and the size of the display device 10 can be changed to accommodate cards of all sizes. In addition, and as will be seen from the following, the materials used to form the various parts of the display device 10 can be chosen to best suit the particular card to be supported.

The display device 10 embodying the invention includes a housing or frame 16 which has a cavity 18, and an aperture or slot 20 for receiving at least part of the display card 12. The display device 10 also includes means housed in the frame 16 for securing part of the display card 12 within the frame 16. In the particular arrangement illustrated in the drawings, the means for securing the card 12 within the frame 16 comprises a flexible member in the form of a spring 24. The spring 24 is elongated and the cavity 18 is also elongated to accommodate the spring. The display device 10 further includes manually operable means at least partially housed in the frame for selectively securing the display card 12 in the frame 16, or for releasing the display card 12 from the frame 16. While various suitable manually operable means can be employed, in the specific arrangement shown in the drawings, the manually operable means includes a pair of slides 26 and 28, although the use of a single slide is possible.

While in the illustrated arrangement the means for securing part of the display card 12 in the frame 16 includes a flexible member which is in the form of an elongated spring 24 and which is located in the elongated cavity 18, in other arrangements the spring may have other configurations and may not be elongated and the cavity may not be elongated, and in other arrangements the flexible member may not be in the form of a spring. In still other arrangements the means for securing may not be in the form of a flexible member.

Figure 2:
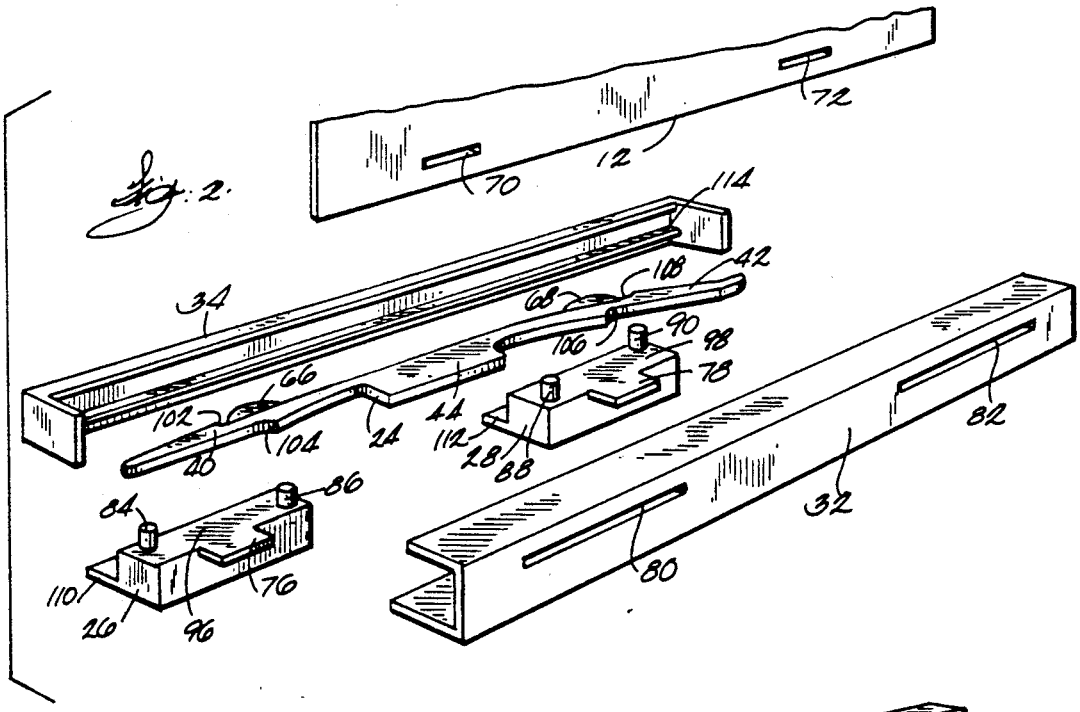
FIG. 2 is an exploded view, in perspective, of the display device shown in FIG. 1, showing each of the components of the display device.
Figure 4:
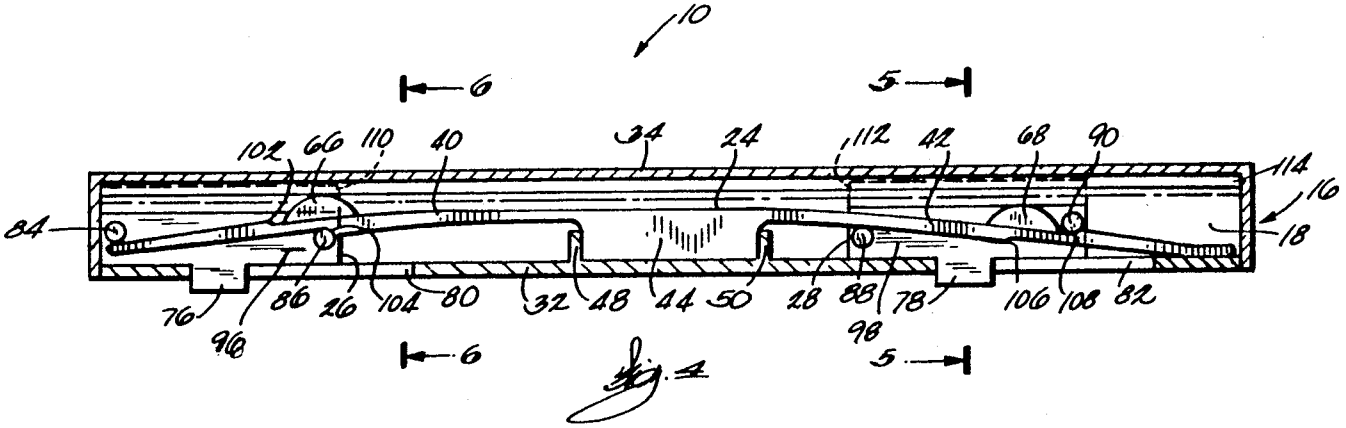
FIG. 4 is a top view, partially in section, of the display device shown in FIG. 1, one side of the display device is shown in a card retaining position and the other side of the display device is shown in a card release position.

As shown best in FIG. 2, the frame 16 preferably includes a pair of elongated housings or frame members, including a front housing or frame member 32 and a rear housing or frame member 34. As shown in FIG. 4, the frame members 32 and 34 are attached to one another to form the frame 16 and to define the cavity 18, and are preferably permanently fixed to one another to provide a sealed frame unit. The provision of a sealed frame 16 assists in making the display device 10 tamper-resistant, since in the arrangement shown in the drawings, the spring 24 and the slides 26 and 28 are, for the most part, inaccessible from the outside of the frame 16.

The frame 16 is easily mounted on a display stand or other structure by means of double-sided adhesive or other conventional, mechanical affixation, and the frame may be mounted at any desired orientation.

While in the illustrated arrangement the frame 16 includes a pair of elongated frame members 32 and 34 permanently fixed to one another to form a sealed frame unit, in other arrangements, the frame may include any number of frame members and the frame members may not be elongated. In still other arrangements the frame members need not be permanently fixed together to provide a sealed unit, but may instead be disassemblable.

Figure 6:
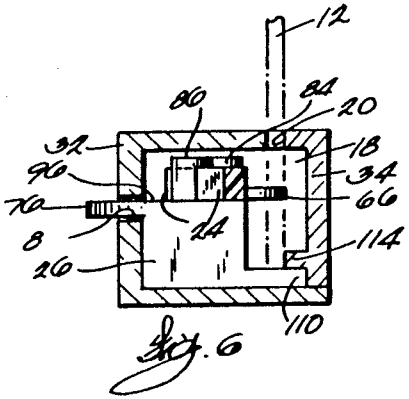
FIG. 6 is an enlarged cross-sectional view of the display device taken along line 6—6 in FIG. 4, and showing the display device in the card retaining position.
Figure 5:
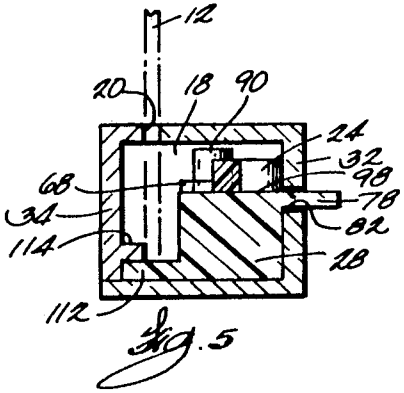
FIG. 5 is an enlarged cross-sectional view of the display device taken along line 5—5 in FIG. 4, and showing the display device in the card releasing position.

Preferably, as shown best in FIGS. 5 and 6, the frame members 32 and 34 assist in supporting the display card 12 in an upright position when the card 12 is inserted into the slot 24. The slot 20 formed in the frame 16 for receiving the display card 12 preferably has dimensions slightly larger than the width and the thickness of the display card 12 to be received to allow for easy insertion of the card 12 into the slot 24. The dimensions of the slot 20 can, however, be slightly smaller than the width and the thickness dimensions of the display card 12 so that the frame 16 assists in gripping the card partially within the frame 16.

Figure 3:
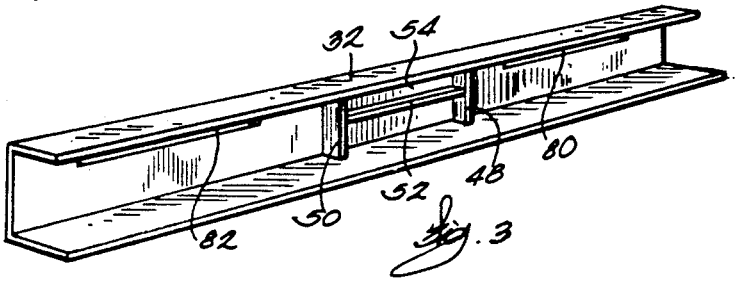
FIG. 3 is a perspective view of the inside of one of the frame members shown in FIG. 2.

As shown in FIG. 2, the elongated spring 24 includes a pair of legs 40 and 42, each of the legs being attached to a center or middle spring portion 44. The middle portion 44 is fixed to one of the frame members 32 and 34 and preferably to the front frame member 32. In the specific arrangement shown in FIG. 3, the front frame member 32 is adapted to receive the middle portion 44. The front frame member 32 includes a pair of spaced transverse members 48 and 50 and a longitudinal member 52 assembled to form a slot 54 which is adapted to receive the middle portion 44 of the spring 24.

While in the illustrated arrangement the middle portion 44 of the spring 24 is shown as being fixed to the front frame member 32 by means of a slot 54, in other arrangements any portion of the spring may be fixed to the frame and the spring can be attached to the frame member by any conventional, mechanical means.

As shown best in FIG. 2, each of the legs 40 and 42 include a card engaging member, the card engaging members comprising a pair of projections 66 and 68 extending outwardly from the legs 40 and 42, respectively. The display card 12 preferably includes a pair of slots 70 and 72 located in the portion of the display card which is to be inserted through the slot 20 and into the frame 16. The slots 70 and 72 are adapted to receive the projections 66 and 68. Each of the projections 66 and 68 and each of the slots 70 and 72 are preferably identical so that either projection can fit into either slot. Each of the projections 66 and 68 is movable between a display card retaining position wherein the projections 66 and 68 protrude into the slots 70 and 72 to prevent removal of the display card 12 from the frame 16, and a card release position wherein the projections 66 and 68 are free of the display card 12, allowing the display card to be inserted into, or removed from the slot 20 of the frame 16.

Referring specifically to FIG. 6, the projection 66 is shown in a card retaining position wherein the projection 66 protrudes into the slot 70 in the display card 12. With the projection 66 extending into the slot 70, the display card 12 is gripped in the frame, providing a secure mounting for the display card and preventing pilfering of the card. Referring specifically to FIG. 5, the projection 68 is shown in a card releasing position wherein the projection 68 is disengaged from the display card 12 so that the card may be easily removed from the frame 16.

While in the illustrated arrangement a pair of legs 40 and 42 each include a card engaging member, each card engaging member comprising a projection 66 and 68 to secure the display card 12 within the frame 16, in other arrangements any number of engaging members can be used and any engaging member configuration which secures the display card within the frame when the engaging member is in the card retaining position may be used.

The display device 10 includes manually operable means for moving the projections 66 and 68 between card retaining and card releasing positions, the manually operable means including the pair of slides 26 and 28. Referring specifically to FIG. 4, the slide 26 is shown in the card retaining position wherein the projection 66 engages the card 12, and the slide 28 is shown in the card release position wherein projection 68 is free of the card 12. The slides 26 and 28 are slideably or shiftably movable within the frame 16 and preferably include tabs 76 and 78, respectively. The tabs 76 and 78 project outwardly from the frame 16 so that they are easily manually operable by finger pressure or other means to impart motion to the slides 26 and 28. No tools are required to move the slides 26 and 28 between card retaining and card releasing positions. To accommodate the tabs 76 and 78, the front frame member 32 includes a pair of openings 80 and 82 for housing the tabs. The openings 80 and 82 serve the additional purpose or assisting in partially restricting the motion of the slides 26 and 28 to sliding motion in the longitudinal direction within the frame 16.

While in the illustrated arrangement the manually operable means for moving the projections 66 and 68 includes a pair of slides 26 and 28, the slides respectively including tabs 76 and 78 for manually imparting sliding motion to the slides, in other arrangements the slides could include other means for imparting motion to the slides, and in still other arrangements, the manually operable means for moving the projections can include components other than slides housed for shiftable movement in the frame.

As shown in FIG. 2, the slides 26 and 28 preferably include a pair cf pins 84 and 86, and 88 and 90, respectively. The spring 24 preferably rests on the surfaces 96 and 98 of the slides 26 and 28. The pins 84 and 86 are preferably offset on the surface 96 of slide 26, and are disposed on either side of the spring 24. The pins 88 and 90 are preferably offset on the surface 98 of the slide 28, and are disposed on either side of the spring 24, so that the slides 26 and 28 are mirror images of each other. The pins 84, 86, 88 and 90 are preferably all in sliding contact with the spring 24, so that when the slides 26 and 28 move in the longitudinal direction within the frame 16, the pins impart movement in the transverse direction to the projections 66 and 68, thereby causing the projections to engage or disengage the display card 12.

While in the illustrated arrangement the slides 26 and 28 each include a pair of pins 84 and 86, and 88 and 90, the pins converting the longitudinal sliding motion of the slides into transverse movement of the projections 66 and 68, in other arrangements the slides may include other means to convert slide movement into projection movement.

The spring legs 40 and 42 are respectively provided with a pair of detents 102 and 104, and 106 and 108. The detents 102, 104, 106 and 108 are adapted to house pins 84, 86, 88 and 90, respectively. The detents and pins cooperate to provide a means for locking the spring 24 so that the projections 66 and 68 can be secured in the card releasing position or in the card retaining position. As shown in FIG. 4, when the pins 84 and 90 are housed by detents 102 and 108 the spring 24 is locked in the card releasing position, and when the pins 86 and 88 are housed in detents 104 and 106 the spring 24 is locked in the card retaining position. When the pins engage the detents, a positive tactile and audible "click" is detectable, indicating the position of the spring 24 and projections 66 and 68 as being locked in either the card retaining position or the card releasing position. The spring 24 can be chosen to bias the projections 66 and 68 towards either the card retaining position or the card releasing position when the spring 24 is unlocked.

To ensure that the slides 26 and 28 are limited to movement in the longitudinal direction, the slides 26 and 28 include guide members 110 and 112, respectively. In the illustrated arrangement the rear frame member 34 includes means defining a track preferably including a track member 114 which cooperates with the openings 80 and 82 housing the tabs 76 and 78 to limit the movement of the slides 26 and 28. Each of the guide members 110 and 112 are at least partially captured by the track member 114 so that movement of the guide members is limited to sliding movement in the longitudinal direction.

The components of the card display device 10 are preferably made of injection molded plastic for purposes of economy and ease. Any suitable material may, however, be used such as plastic, metal, wood, and the like, and any suitable forming means may also be employed. The material and component forming methods can be tailored to the particular environment in which the display device 10 will be located, and to the particular card to be supported.

Various features of the invention are set forth in the following claims.

I claim:

1. A display device for supporting a display card, said display device comprising:

a frame having an aperture for receiving at least a portion of the display card;

means housed in said frame for securing said at least a portion of the display card within the frame, said means for securing including a card engaging member movable between a card retaining position wherein the card engaging member engages the display card and prevents removal of the card from the frame, and a card releasing position; and manually operable means at least partially housed in said frame for selectively moving said card engaging member between the card retaining position and the card releasing position, said manually operable means including a slide supported by said frame for shiftable movement.

2. A display device as set forth in claim 1, wherein said means for securing includes a flexible member, said flexible member including a first portion fixed to said frame and a second portion including said card engaging member, said second portion of said flexible member being movable between said card retaining position and said card releasing position.

3. A display device for supporting a display card, said display device comprising:

a frame having an aperture for receiving at least a portion of the display card;

means housed in said frame for securing said at least a portion of the display card within the frame, said means for securing including a flexible member movable between a card retaining position wherein the flexible member engages the display card and prevents removal of the card from the frame, and a card releasing position;

manually operable means at least partially housed in said frame for selectively moving said flexible member between the card retaining position and the card releasing position; and means for locking said flexible member in one of the card retaining position and the card releasing position.

4. A display device as set forth in claim 2, wherein said slide includes a tab projecting outwardly from the frame, said tab being manually operable to provide movement to said slide.

5. A display device as set forth in claim 4, wherein said frame includes a pair of frame members, said frame members being attached to one another to form said frame and said frame members defining a cavity.

6. A display device as set forth in claim 5, wherein said frame members are elongated and said cavity is elongated, and wherein said flexible member is elongated.

7. A display device as set forth in claim 6, wherein said elongated flexible member comprises an elongated spring.

8. A display device as set forth in claim 5, wherein one of said frame members includes means for defining a track, and wherein said slide includes a guide member, said guide member being restricted to movement within said means for defining a track.

9. A display device as set forth in claim 4, wherein said manually operable means includes a first pin attached to said slide, said first pin slideably engaging said second portion of said flexible member, and wherein said flexible member includes therein a first detent, said first detent adapted to house said first pin such that when said first pin is housed in said first detent, said flexible member is releasably locked in said card retaining position.

10. A display device as set forth in claim 9, wherein said manually operable means includes a second pin attached to said slide, said second pin slideably engaging said second portion of said flexible member, and wherein said flexible member includes therein a second detent, said second detent adapted to house said second pin such that when said second pin is housed in said second detent, said flexible member is releaseably locked in said card releasing position.

11. A display device as set forth in claim 4, wherein said manually operable means includes a first pin attached to said slide, said first pin slideably engaging said second portion of said flexible member, and wherein said flexible member includes therein a first detent, said first detent adapted to house said first pin such that when said pin is housed in said first detent, said flexible member is releaseably locked in the card releasing position.

12. A display device for supporting a display card, said display device comprising:

a frame having an aperture for receiving at least a portion of the card;

a flexible member housed in said frame, said flexible member including a first portion fixed to said frame, and a second portion, said flexible member including a card engaging member attached to said second portion, said card engaging member being movable between a card retaining position wherein said card engaging member engages the display card and prevents removal of the card from said frame, and a card releasing position;

a manually operable slide at least partially housed in said frame and supported by said frame for shiftable movement, said slide being in at least intermittent contact with said flexible member to selectively move said care engaging member between said card releasing position and said card retaining position.

13. A display device as set forth in claim 12, the card including a slot, wherein said card engaging member comprises a projection, said card engaging member protruding into the slot in the card when said card engaging member is in said card retaining position to retain the card within said frame.

14. A display device as set forth in claim 12, wherein said frame includes a pair of frame members, said frame members being attached to one another to form said frame and said frame members defining a cavity.

15. A display device as set forth in claim 14, wherein said frame members are elongated and said frame members define an elongated cavity, and wherein said flexible member is elongated.

16. A display device as set forth in claim 15, wherein said elongated flexible member comprises an elongated spring.

17. A display device as set forth in claim 14, wherein one of said frame members includes means for defining a track, and wherein said slide includes a guide member, said guide member being restricted to movement within said means for defining a track.

18. A display device as set forth in claim 12, wherein said slide includes a tab, said tab projecting outwardly from said frame and being manually operable to provide movement to said slide.

19. A display device as set forth in claim 12, wherein said slide includes a first pin attached to said slide, said first pin slideably engaging said second portion of said flexible member, and wherein said flexible member includes therein a first detent, said first detent adapted to house said first pin such that when said pin is housed in said first detent, said card engaging member is releaseably locked in the card retaining position.

20. A display device as set forth in claim 19, wherein said slide includes a second pin attached to said slide, said second pin slideably engaging said second portion of said flexible member, and wherein said flexible member includes therein a second detent, said second detent adapted to house said pin such that when said second pin engages said second detent, said card engaging member is releaseably locked in the card releasing position.

21. A display device as set forth in claim 12, wherein said slide includes a first pin attached to said slide, said first pin slideably engaging said second portion of said flexible member, and wherein said flexible member includes therein a first detent, said first detent adapted to house said first pin such that when said pin is housed in said first detent, said card engaging member is releaseably locked in the releasing position.

22. A display device for supporting a display card having therein a slot, said display device comprising:

a frame having an aperture for receiving at least a portion of the display card;

means housed in said frame for securing said at least a portion of the display card within the frame, said means for securing including a card engaging member including a projection, said card engaging member being movable between a card retaining position wherein the projection protrudes into the slot in the card to retain the card within said frame, and a card releasing position; and manually operable means at least partially housed in said frame for selectively moving said card engaging member between the card retaining position and the card releasing position.

23. A display device as set forth in claim 22, wherein said means for securing includes a flexible member, said flexible member including a first portion fixed to said frame and a second portion including said card engaging member, said second portion of said flexible member being movable between said card retaining position and said card releasing position.

24. A display device as set forth in claim 3, wherein said means for locking includes means for audibly and tactily indicating when said flexible member is in said one of the card retaining position and the card releasing position.

* * * * *